US005144750A

United States Patent [19]

Mandel

[11] Patent Number: 5,144,750

[45] Date of Patent: Sep. 8, 1992

[54] LISTING APPARATUS

[76] Inventor: Linda L. Mandel, 1100 Eckenrode Way, Placentia, Calif. 92670

[21] Appl. No.: 782,415

[22] Filed: Oct. 25, 1991

[51] Int. Cl.[5] ..... B26F 1/00

[52] U.S. Cl. ..... 30/368; 30/368; 83/520; 283/73; 283/100; 283/104; 283/105

[58] Field of Search ..... 30/358, 366, 367, 368; 83/520; 283/73, 100, 104, 105

[56] References Cited

U.S. PATENT DOCUMENTS

| | | | |
|---|---|---|---|
| 2,726,721 | 12/1955 | Segal | 30/358 |
| 2,868,293 | 1/1959 | Kearse | 30/358 |
| 4,020,554 | 5/1977 | Latourette | 30/368 |
| 4,823,468 | 4/1989 | Kollegger | 30/368 |

FOREIGN PATENT DOCUMENTS

| | | | |
|---|---|---|---|
| 114288 | 6/1945 | Sweden | 30/358 |

*Primary Examiner*—Hien H. Phan

[57] ABSTRACT

A listing apparatus, comprising, in its broadest aspects, a transparent plastic coverplate, a rigid backplate, and a spring punch assembly. The rigid, transparent, plastic coverplate includes a coverplate slot system comprising a plurality of interconnected coverplate listing slots being connected by at least one coverplate connecting slot. The rigid backplate has a plurality of backplate slots disposed therein, the rigid backplate being securely disposed in a spaced relationship with the clear plastic coverplate. The backplate slots are aligned with the coverplate listing slots. The spring punch assembly, which includes a punch rod, is located within the coverplate slot system and slidable therethrough. Connectors provide the spaced relationship between the clear plastic cover and the rigid backplate so as to accommodate a list to be inserted therebetween. Therefore, an operator may insert the list between the rigid backplate and the plastic coverplate, view the list through the plastic coverplate, and selectively indicate items listed on the list, by punching holes in the list.

6 Claims, 2 Drawing Sheets

FIG. 3
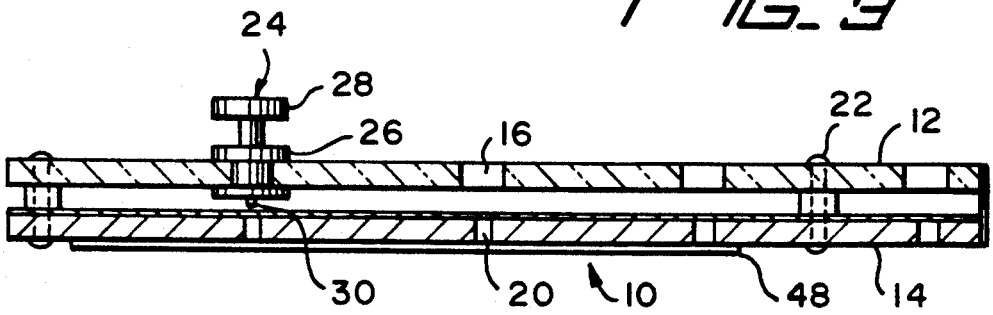
FIG. 4
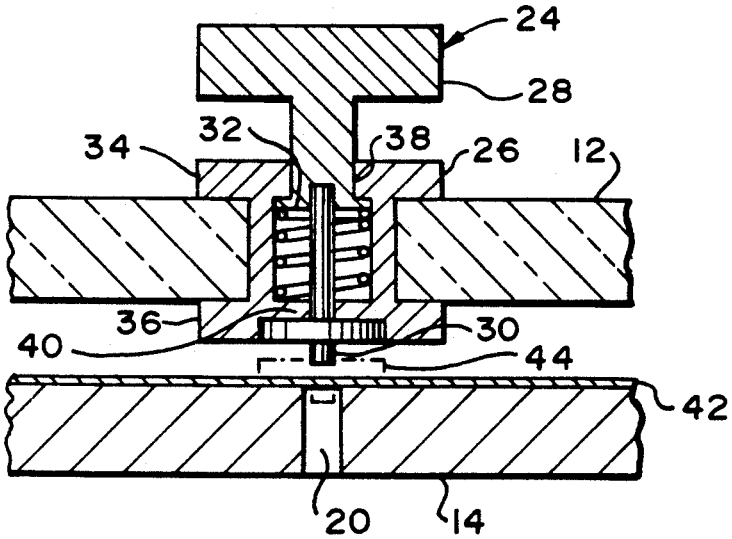
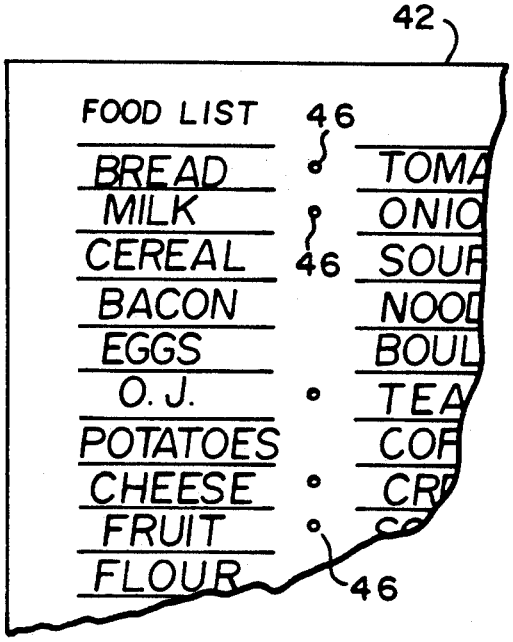
FIG. 5

LISTING APPARATUS

BACKGROUND OF THE INVENTION

1. Field of the Invention

The present invention relates to improvements in listing apparatus and, more particularly, to an improved grocery listing device including a sliding punch engaged in a slotted coverplate of the device for conveniently creating a list of desired grocery items.

2. Description of the Related Art

There have been many attempts to improve a shopper's ability to easily compile and provide readily accessible grocery lists. For example, U.S. Pat. No. 2,392,488, issued to J. Maccallum, Jr., entitled "LISTING MACHINE", discloses a listing machine for providing lists from a paper feed roll. The listing machine includes punching devices bracketed at the side edges of the machine for forming cutouts adjacent to side edges of the paper roll indicating desired items to be listed.

Similarly, U.S. Pat. No. 2,174,088, issued to H. K. Jensen, entitled "LISTING APPARATUS", discloses another listing apparatus which forms perforations adjacent to side edges of a list. With the Jensen device a series of punches are aligned along the edges of the listing apparatus.

U.S Pat. No. 2,460,549, issued to E. Stiles, entitled "DEVICE FOR RECORDING GROCERY WANT-LISTS", discloses a device having a vertically disposed slot for accommodating a block-like runner. Affixed to the runner are puncturing recorder tips for perforating a listing sheet. Similarly, U.S. Pat. No. 4,020,554, issued to E. E. La Tuertte, entitled "PORTABLE PUNCH", discloses another punching device with a vertically disposed slot for supporting a punching mechanism.

Other examples of punching devices shown in the prior art include U.S. Pat. No. 2,868,293, issued to M. S. Kearse, entitled "POCKET CALENDAR DEVICE WITH PUNCH MEANS"; U.S. Pat. No. 1,839,415, issued to D. F. Schumacher, entitled "HAND PUNCH" which discloses a punching device for perforating record cards; and U.S. Pat. No. 3,226,019, issued to D. J. Byrnes, Jr., entitled "VOTING MECHANISM".

Most of the prior art suffers from similar deficiencies. The devices are generally of complicated construction, contain many moving parts, are limited in the amount of items that may be listed, and are expensive to fabricate. As will be disclosed below, the present invention provides a solution for these abovementioned deficiencies.

SUMMARY OF THE INVENTION

The present invention is a listing apparatus, comprising, in its broadest aspects, a transparent plastic coverplate, a rigid backplate, and a spring punch assembly. The rigid, transparent, plastic coverplate includes a coverplate slot system comprising a plurality of interconnected coverplate listing slots being connected by at least one coverplate connecting slot. The rigid backplate has a plurality of backplate slots disposed therein, the rigid backplate being securely disposed in a spaced relationship with the clear plastic coverplate. The backplate slots are aligned with the coverplate listing slots. The spring punch assembly, which includes a punch rod, is located within the coverplate slot system and slidable therethrough. Connector means provide the spaced relationship between the clear plastic cover and the rigid backplate so as to accommodate a list to be inserted therebetween. Therefore, an operator may insert the list between the rigid backplate and the plastic coverplate, view the list through the plastic coverplate, and selectively indicate items listed on the list, by punching holes in the list.

The present invention is lightweight, durable and inexpensive to produce. It has only one moving part and is simple to operate. Utilizing a networked slot system provides the facility to list more items than the slotted devices of the prior art.

Other objects, advantages and novel features of the present invention will become apparent from the following detailed description of the invention when considered in conjunction with the accompanying drawings.

BRIEF DESCRIPTION OF THE DRAWINGS

FIG. 3 is a side view of the listing apparatus, shown along line 3—3 of FIG. 2.

FIG. 4 is a cross-sectional view of the spring punch assembly used in the present invention illustrating its engagement with the plastic coverplate.

FIG. 5 illustrates an example of a food list having been punched to indicate selected items.

The same elements or parts throughout the figures of the drawings are designated by the same reference characters.

DETAILED DESCRIPTION OF THE PREFERRED EMBODIMENT

Figure 1:
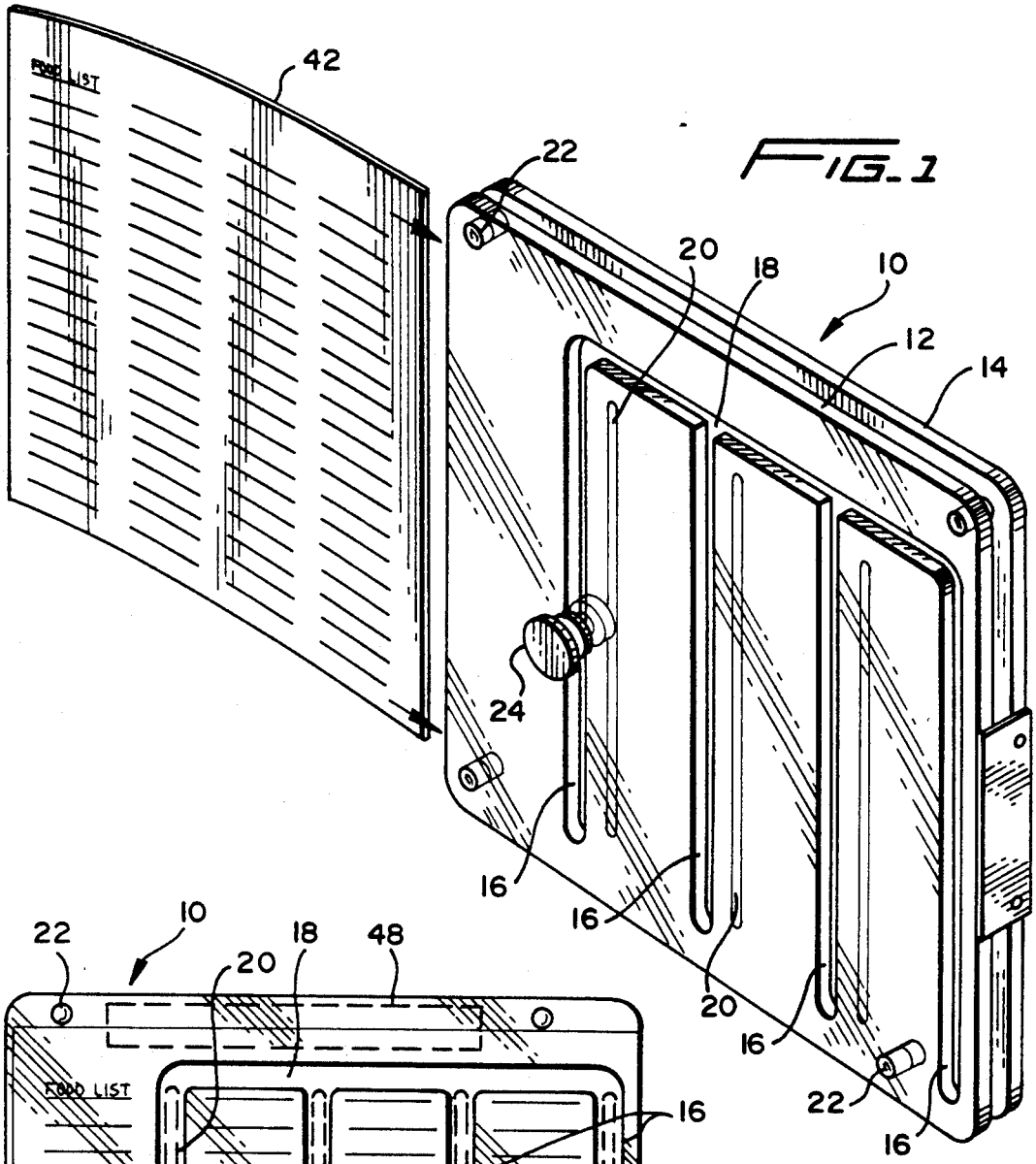
FIG. 1 is a perspective illustration of the listing apparatus of the present invention, shown with a food list being inserted therein.

Referring to the drawings and the characters of reference marked thereon, FIG. 1 illustrates the grocery listing apparatus of the present invention, designated generally as 10. Listing apparatus 10, includes a rigid, transparent plastic coverplate 12 mounted to a rigid backplate 14. Coverplate 12 has a coverplate slot system comprising four spaced, vertically directed coverplate listing slots 16 connected at an upper end by a single, horizontal coverplate connecting slot 18.

Figure 2:
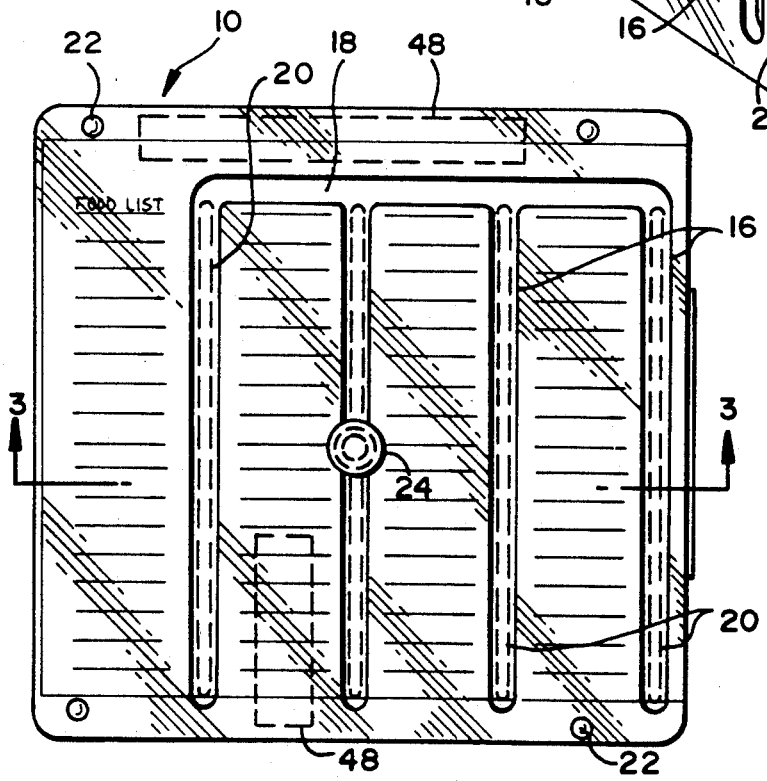
FIG. 2 is a front elevational view of the listing apparatus, with the grocery list shown inserted therein.

The rigid backplate 14 includes four spaced vertical backplate slots 20 which are aligned with the coverplate listing slots 16, as best seen in FIG. 2. (The backplate slots 20 are represented by dashed lines in FIG. 2.) The plastic coverplate 12 is securely mounted to the backplate 14 by four connectors 22.

As can be seen clearly in FIGS. 3 and 4, a spring punch assembly, designated generally as 24 is located within the coverplate slot system and is slidable therethrough. Spring punch assembly 24 comprises a base 26, a handle 28, a punch rod 30, and a coiled spring 32.

The base 26 has spaced top and bottom flanges 34, 36 formed thereon. Slot forming portions of the plastic cover 12 are disposed between the flanges 34 and 36 so that the base 26 is contained within the slot system. The base 26 further comprises an upper end portion 38 with an upper opening formed therein. This upper opening provides access to a space formed between upper end portion 38 and a lower end portion 40 of the base 26. The coiled spring 32 is located within the space for biasing the handle 28 in an upward direction.

The punch rod 30 is supported within the base 26 and extends through a lower opening of the lower end portion 40 of the base 26. An upper end of the punch rod 30 abuts the lower end of the handle 28.

During operation of the grocery listing apparatus 10, a food list 42 is slid within the space formed between the coverplate 12 and backplate 14, as illustrated in FIG. 1. Thus, the food list 42 can be viewed through the transparent coverplate 12, as can be seen in FIG. 2.

Referring again to FIG. 4, as denoted by dashed lines 43, when the spring punch assembly 24 is depressed, the punch rod 30 is pushed through the backplate slot 20, thereby preforating a hole in a desired location in the food list 42. A collar 44 secured to the punch rod 30 provides a back stop and front stp for the punch rod.

The spring punch assembly 24 can e moved to its desired location along a particular vertical slot and can also be moved between different vertical slots. Thus, with use of a single punch assembly a large number of grocery items may be selectively indicated. FIG. 5 illustrates an example of a portion of a food list 42 with certain items being indicated by perforations 46.

It is therefore readily seen that the grocery listing apparatus of the present invention is simple to operate, reliable, and requires little maintenance while obtaining accuracy in its listing function.

Although the present invention has been explained in detail with regard to its use for compiling a grocery/-marketing list 42, the device is not limited to this particular purpose, and may be used with properly legended sheets for preparing lists of any character.

One or more magnets 48 are preferably secured to a rear face of the backplate 14 to allow the apparatus 10 to be easily secured to, for example, a refrigerator or shopping cart.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A listing apparatus, comprising:

a) a rigid, transparent, plastic coverplate having a coverplate slot system comprising a plurality of interconnected coverplate listing slots being connected by at least one coverplate connecting slot;

b) a rigid backplate having a plurality of backplate slots disposed therein, said rigid backplate being securely disposed in a spaced relationship from said clear plastic coverplate, said backplate slots being aligned with said coverplate listing slots;

c) a spring punch assembly located within said coverplate slot system and slidable therethrough, said spring punch assembly having a punch rod located therein; and, d) connector means for providing such a spaced relationship between said transparent plastic cover and said rigid backplate so as to accommodate a list to be inserted therebetween, wherein an operator may insert said list between said rigid backplate and said plastic coverplate, view said list through said plastic coverplate, and selectively indicate items listed on said list, by punching holes in said list.

2. The listing apparatus of claim 1, wherein, said interconnected coverplate listing slots comprising a plurality of spaced vertical coverplate listing slots each being connected at one end thereof by said connecting slot which extends horizontally.

3. The listing apparatus of claim 1, wherein, said list comprises a grocery shopping list.

4. The listing apparatus of claim 2 wherein, said backplate slot include a plurality of spaced vertically directed backplate slots aligned with said vertical coverplate listing slots.

5. The listing apparatus of claim 1 wherein, said spring punch assembly comprises;

a) a base having spaced top and bottom flanges located thereon, said interconnected slots comprising slot forming portions which are disposed between the flanges to securely and slidably hold said base within said slot system, said base further comprising an upper end portion and a lower end portion, said upper end portion having an upper opening formed therein, said lower end portion having a lower opening formed therein, a space formed in said base between said upper end portion said lower end portion;

b) a handle having a lower end extending through said upper opening;

c) a punch rod supported within said base and extending through the lower opening in said base, an upper end of said punch rod abutting said lower end of said handle; and, d) a coiled spring located within said space formed in said base for urging said handle toward an upward direction, wherein during operation of said spring punch assembly said handle is depressed to push said punch rod through one of said backplate slots, thereby perforating a hole in a desired location in said list.

6. The listing apparatus of claim 1, further including at least one magnet attached to a rear face of said rigid backplate.

* * * * *